US006044739A

United States Patent [19]

Abler et al.

[11] Patent Number: 6,044,739

[45] Date of Patent: Apr. 4, 2000

[54] FOOD MATERIAL DECURLING APPARATUS AND METHOD

[75] Inventors: Norman C. Abler, Madison; James A. Rattmann, Marshall; Donald W. Hamburg, Sun Prairie, all of Wis.

[73] Assignee: Kraft Foods, Inc., Northfield, Ill.

[21] Appl. No.: 08/902,874

[22] Filed: Jul. 30, 1997

[51] Int. Cl.[7] ..... B26D 7/32; B26D 7/06

[52] U.S. Cl. ..... 83/88; 83/155; 83/165; 83/703; 83/714; 83/409.2; 83/410.8; 83/733; 83/439; 83/443; 83/468.7; 83/856; 83/932; 426/518; 99/537

[58] Field of Search ..... 83/88, 91, 94, 83/112, 155, 161, 163, 165, 703, 713, 714, 730, 409.2, 410.8, 411.4, 435.11, 437.1, 733, 439, 440, 443, 448, 467.1, 468.2, 468.7, 850, 932; 425/289, 315; 426/518, 420; 222/80; 99/537, 589

[56] References Cited

U.S. PATENT DOCUMENTS

| | | | |
|---|---|---|---|
| 1,522,002 | 1/1925 | Elster | 83/713 |
| 3,851,554 | 12/1974 | Papai . | |
| 4,270,910 | 6/1981 | Himmelsbach . | |
| 4,348,923 | 9/1982 | Huston et al. | 83/730 X |
| 4,436,012 | 3/1984 | Hochanadel . | |
| 4,543,864 | 10/1985 | Hochanadel et al. | 83/703 X |
| 4,586,409 | 5/1986 | Kuchler . | |
| 4,913,019 | 4/1990 | Hayashi | 83/437.1 X |
| 4,960,025 | 10/1990 | Fitch . | |
| 4,987,809 | 1/1991 | Price . | |
| 5,051,268 | 9/1991 | Mally | 426/420 |
| 5,149,554 | 9/1992 | Abler . | |
| 5,230,267 | 7/1993 | Abler . | |
| 5,232,713 | 8/1993 | Morikawa et al. | 425/140 |
| 5,410,929 | 5/1995 | Wallace | 83/160 |
| 5,784,936 | 7/1998 | King | 83/437.1 X |

FOREIGN PATENT DOCUMENTS

| | | | |
|---|---|---|---|
| 655381 | 1/1938 | Germany . | |
| 406320493 | 11/1994 | Japan | 83/24 |

*Primary Examiner*—Rinaldi I. Rada
*Assistant Examiner*—Boyer Ashley
*Attorney, Agent, or Firm*—Cook, Alex, McFarron, Manzo, Cummings & Mehler, Ltd.

[57] ABSTRACT

An apparatus for decurling food material, such as slices severed from a food material supply, while the slices are being moved toward a transfer member includes a constriction positioned in close proximity to the slicing station and in general alignment therewith. The constriction is defined by opposing upper and lower surfaces; the upper surface is a stationary surface while the lower surface is a moving surface. The lower moving surface utilizes a plurality of flexible bands rotating around at least one roller, which are disposed proximate to the food material supply. The flexible bands are driven around a guide member having an arcuate profile that matches the curvature movement that the food material supply takes. The bands which form the lower moving surface are driven at a speed equal to or greater than the speed at which the slicer operates.

25 Claims, 6 Drawing Sheets

FOOD MATERIAL DECURLING APPARATUS AND METHOD

BACKGROUND OF THE INVENTION

The present invention relates generally to the slicing of food materials, and more particularly to an apparatus for use in the slicing of food materials and which prevents the curling of food material slices during the slicing thereof.

Automated slicing is commonly used in the processing of various food materials. In some slicing applications, at least one food material supply is held in a magazine that is repeatedly moved against a knife to successively obtain a series of slices from the food material. The movement of the food material supply magazine against the knife has a reciprocating, or oscillating cycle, wherein each cycle produces a food material slice during forward movement of the food material supply against the knife. The slices so obtained by such slicers are, in essence, thrown onto a transfer surface, such as a food material packaging tray, or a moving surface like a food transfer conveyor.

Curling of the food material slices is a problem which occurs frequently with food slicers of the type described above. Curling is exacerbated by the temperature of the food material supply. If the food material supply is in a somewhat frozen state, the slice curls as it is sliced because of the low temperature of the food material, much like a wood chip obtained from a carpenter's plane. However, in other instances, energy is imparted to the food material slice during the slicing process which warms the surfaces of the slice and may cause it to become tacky or partially adhesive in nature whereupon it is likely to adhere to surfaces it contacts such as the slicing knife or a transfer assembly. A range of desired temperatures exists at which the tendency of a food material slice to curl or adhere to processing components is tolerable. However, even within this range, curling nevertheless occurs.

The curling that occurs may detrimentally affect the ability of the slice transfer or knife components to properly convey the food material slices. The curl of the slice most often detrimentally affects the trajectory of the slice as it is sliced and thrown onto a transfer component. This curling of such food material slices may affect other components in the food material production line. Additionally, curling occurs in the slicing of hard, dry sausages such as pepperoni or salami.

Certain apparatus for removing or reducing the curling of a food material slice are known. U.S. Pat. No. 5,230,267, issued Jul. 27, 1993, and commonly owned by the assignee of the present invention describes an apparatus having a constriction aligned with and located close to a slicing knife. This construction includes two opposing surfaces, one moving surface and one stationary surface. The upper surface of the construction is stationary while the lower surface is a moving surface composed of flexible bands driven by two rollers at opposite ends of the apparatus. This apparatus, although effective, requires two rollers to carry out its decurling purpose.

SUMMARY OF THE INVENTION

The present invention is directed to a device which overcomes the aforementioned disadvantages, provides an apparatus which enables a substantial increase in slicing speed to be achieved in an associated slicing assembly and represents an improvement over the apparatus described in the aforementioned U.S. Pat. No. 5,230,267.

In this regard, the present invention provides a constriction located near, and preferably below, the slicing assembly, and having a moving surface which moves at a speed at least substantially equal to or greater than the slicing speed. This lower moving surface exerts the most influence on the food material slice movement and therefore provides a moving surface as part of the constriction, so that individual successive food material slices are prevented from curling without significantly altering their course of movement through the constriction.

In one embodiment, the present invention includes a curved slice thickness, or guide plate, having a series of grooves which accommodate an equal number of elastic bands or flexible belts. The slice thickness plate is convex in configuration and has a outer surface that preferably matches the swinging path of the food supply magazine. Preferably, the swinging path of the food supply magazine in this embodiment defines a curved path. The bands travel through the guide plate beneath its outer surface and are driven by a single driving roller. A leading edge of the guide plate provides a change in direction of the bands to position the moving lower surface of the constriction a preselected distance away from the portion of the knife assembly which serves as the fixed upper surface of the constriction. The bands direct the slices onto a suitable transfer means for transfer to another work station on the production line. The curvature of the guide plate matches the path of the food supply magazine and prevents the food supply from being pinched against the guide plate during movement of the food supply magazine.

In another embodiment, wherein the food supply magazine oscillates back and forth in a linear path with translational rather than rotational movement, the guide plate is planar in order to match the path of the food supply magazine and so permits the reduction of curl in slices made from multiple food items held in the food supply magazine so that as multiple slices are made, they are uncurled.

Accordingly, it is an object of the present invention to provide a device for maintaining a slice of food material freshly cut from a food material supply in a substantially flat configuration.

Another object of the present invention as exemplified by a first embodiment of the invention is to provide a food slice decurling device particularly suitable for use with a food material slicing apparatus in which a food material supply is reciprocatably moved in an arc through a food slicing zone, whereby movement of the food material supply in one direction causes the food material supply to contact a cutting edge and to produce a slice of food material that is not curled. The decurling device includes a constriction positioned proximate to the slicing apparatus knife edge, the constriction having a first stationary surface forming the upper portion of the constriction and a second, moving surface forming the lower portion of the constriction.

Yet another object of the present invention is to provide an apparatus for preventing curling from occurring in successive slices of food material sliced from a food material supply wherein the apparatus includes a curved slice thickness and guide plate assembly, the assembly including a moving surface extending through the assembly and beneath the outer, curved surfaces thereof to a location near the slicing knife, the moving surface being formed by a plurality of moving elements, such as elastic bands, the bands forming the moving, lower surface of a constriction disposed proximate to the slicer, changing direction at a leading edge of the guide plate and further moving at a speed nominally equal to or greater than the speed at which slices are made from the food material supply.

Still another object of the present invention, as exemplified by a second embodiment of the invention, is to provide an apparatus for substantially preventing curling of food material slices sliced from a food material supply, wherein the supply may include multiple food material sticks and wherein the apparatus includes a slicing knife mounted in a first guide plate disposed beneath the food material supply, a second guide plate spaced apart from the first guide plate, also beneath the food material supply, the second guide plate further having a plurality of food material contact members that are moved around the second guide plate in the same direction as the food material supply and at approximately the same or greater speed thereof.

These and other objects, features and advantages of the present invention will become more readily apparent from a reading of the following detailed description taken in conjunction with the accompanying drawings wherein like reference numeral refer to like parts.

BRIEF DESCRIPTION OF THE DRAWINGS

In the course of this detailed description, reference will be made to the attached drawings in which.

DETAILED DESCRIPTION OF THE PREFERRED EMBODIMENTS

Figure 1:
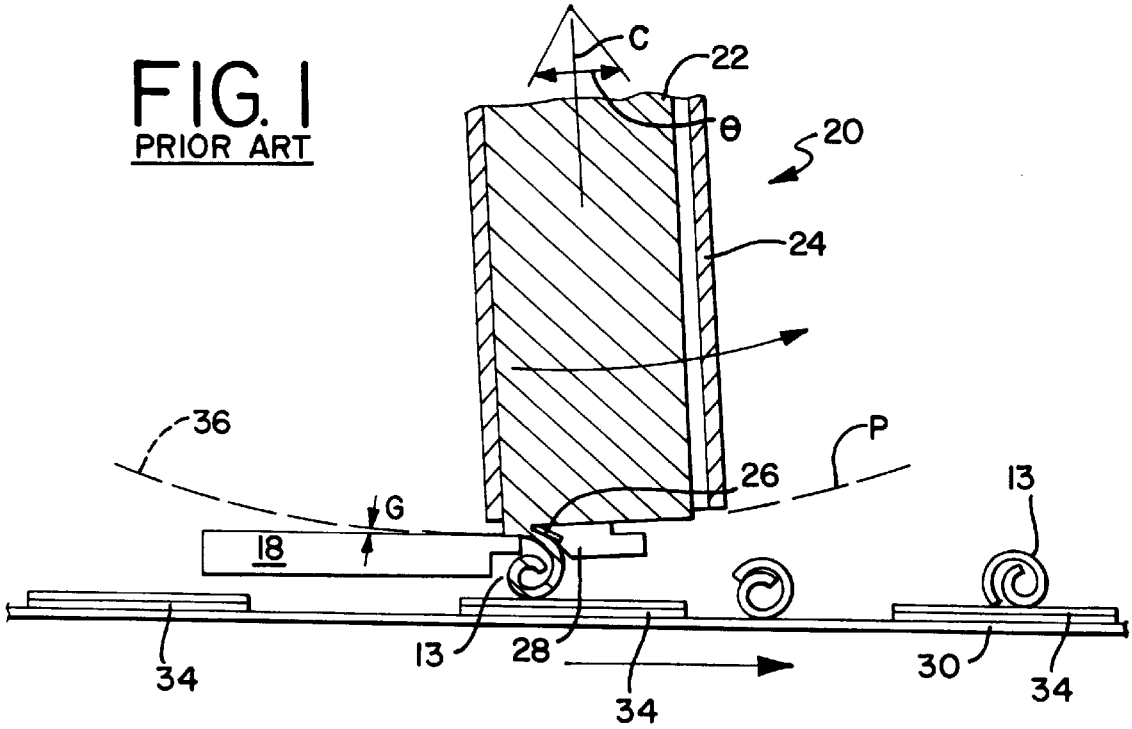
FIG. 1 PRIOR ART
FIG. 1 is a sectional view of a prior art food slicing apparatus.

FIG. 1 illustrates a conventional slicing assembly 20 particularly suitable for successively slicing slices from a food material supply 22, such as bacon. The food material 22 is held within a magazine 24 which reciprocates, or oscillates back and forth, in the manner shown in FIG. 1 along a curved path P such that the food material supply 22 is brought into contact with a stationary slicing knife 26 during movement of the food material supply 22 in one direction (shown as to the right along the arrow in FIG. 1.). The knife 26 is maintained within a knife holder 28 positioned generally underneath the food material supply magazine 24 and in close proximity thereto. Such a slicing assembly 20 is commonly used in the art and is known as a "Grote" slicer.

A planar or flat guide plate 18, is provided for use with the slicing assembly 20 and it is adjustably mounted with the assembly 20 so it may be moved within a range of distances away from the knife 26 to select the desired final thickness of the food material slice 13 severed from the food material supply 22. The spacing between the guide plate 18 and the slicing knife 26 defines a gap G through which the food slices 13 pass. As seen from FIG. 1, the food material slices 13, especially when the food material supply 22 is a hard or relatively dry meat product, such as pepperoni, salami or the like, have a tendency to curl severely. This curling may result in chaotic placement of slices 13 on a conveyor belt 30 or any packaging material being transported by the conveyor belt 30. The food material slices 13 are also thrown out of their placement position onto other slices (which may be made as premade meat setups 34). This out-of-position placement detrimentally affects the production quality and speed.

The food supply magazine 24 reciprocates along a curved cycle path 36 through a pre-determined angle θ. While the magazine 24 traverses this arcuate path, the food material supply 22 is shifted downwardly with every cycle or oscillation of the food supply magazine 24 and prior to the forward (to the right) movement of the food supply magazine 24. A gap G occurs between the guide plate 18 and the magazine 24 which diverges from the centerline C of the slicing assembly 20 to the endpoints of the magazine's cyclical movement. This diverging gap allows the food material, at times, to become pinched against the guide plate 18 and dragged out of position in the magazine 24.

Figure 2:
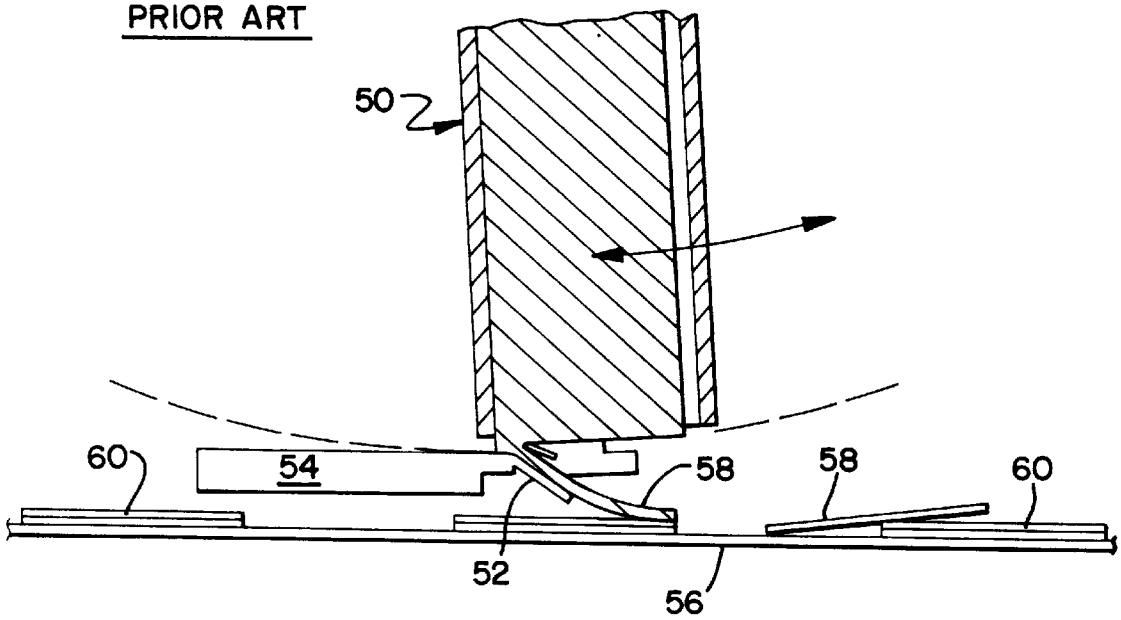
FIG. 2 PRIOR ART
FIG. 2 is a sectional view of a prior art food slice decurling apparatus, that passively decurls food material slices using rigid decurler rods.

FIG. 2 illustrates another known slicing assembly 50 utilizing a "passive" decurling apparatus which employs rigid decurling rods 52 that extend at the end of the planar guide plate 54 and that are angled toward the conveyor belt 56. Although the slices 58 come off relatively flat and straight, friction occurs between the rods 52 and the meat slices 58 which results in inconsistent placement of the slices 58 upon the conveyor belt 56, and other premade setups 60 consisting of multiple slices stacked upon each other.

Figure 3:
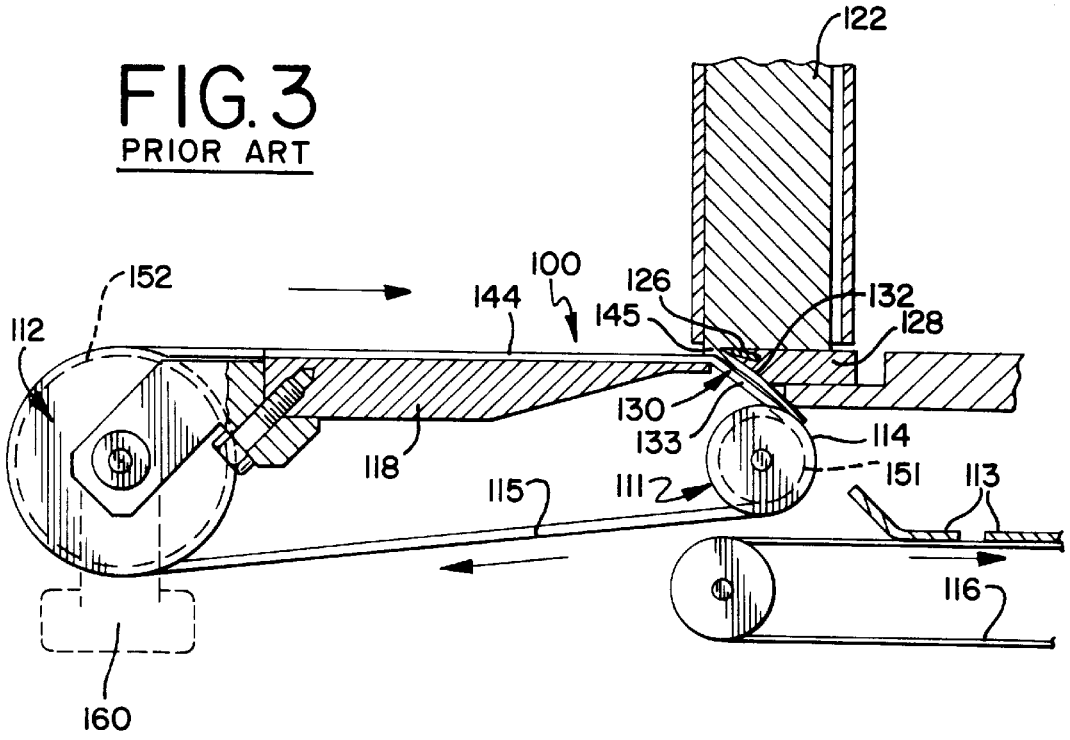
FIG. 3 PRIOR ART
FIG. 3 is a sectional view of another prior art food slice decurling device as described in U.S. Pat. No. 5,230,267 that actively decurls food material slices using two rollers in association.

Turning now to FIG. 3, another known material slice decurling apparatus 100 as described in U.S. Pat. No. 5,230,267 is illustrated. In this known apparatus 100, the severed food material slices 113 are thrown from a cutting zone to a receiving conveyor 116. This apparatus 100 includes two rollers 111, 112 spaced apart from each other and interconnected by a plurality of elastic bands 115 held within grooves 151, 152 of the rollers 111, 112. The bands 115 are directed toward the food material supply 122 by a planar guide plate 118 and traverse the length of the guide plate 118 through a plurality of spaced-apart grooves 144. At the leading edge 145 of the plate 118, the bands 115 are angled downwardly toward the roller 111.

As described in the last mentioned patent, the bands 115 define a moving, lower surface 133 spaced apart from a stationary, upper surface 132 on the knife holder 128 which holds the slicing knife 126. These moving and stationary surfaces 133 and 132 together define a constriction 130 through which the slice 113 must pass after it is sliced by the knife 126. Because the roller 111 has no internal vacuum system, or other means by which to adhere slices 113 to its outer surface 114, the slices 113 are thrown through the airspace separating the roller 111 and the receiving conveyor 116 by a combination of the force imparted thereto by the slicing knife 126 and the movement of the bands 115. Either of the two rollers 111, 112 may be driven to control the speed of the bands 115, and hence, the moving surface 133. The drive mechanism 160 of the apparatus 100 may be indexed or otherwise connected to the slicing assembly to move at either about the same speed therewith or greater.

Figure 4:
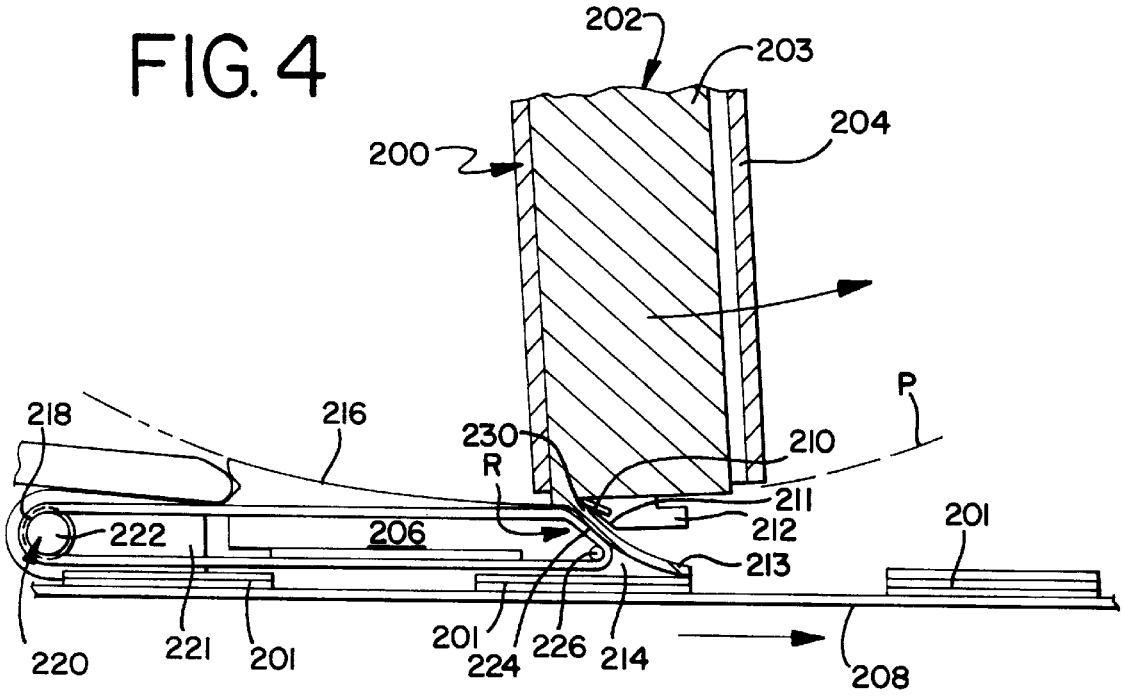
FIG. 4 is a schematic sectional view of a food slice decurling apparatus constructed in accordance with the principles of the present invention.

FIG. 4 illustrates one embodiment of an improved food slice decurling apparatus 200 constructed in accordance with the principles of the present invention that provides beneficial results when used in the production of premade food slice setups 201. This apparatus 200 includes a food material supply 202 that consists of either a single "stick" 203 of food material or of multiple "sticks" deployed substantially transverse of the oscillating path. The sticks 203 are held within a reciprocating food supply magazine 204. The magazine 204 is rotatably disposed above a guide plate 206 and a conveyor belt 208. A slicing knife 210 is located beneath the magazine 204 and is set within a knife holder 212 located generally opposite a leading edge 214 of the apparatus 200 that ramps or angles down from the guide plate 206. The food supply magazine 204 oscillates in a swinging work path P back and forth above the knife holder 212.

In an important aspect of the present invention, the guide plate 206 has an arcuate exterior surface 216, shown as a convex upper surface of the guide plate 206 in the Figures, that approximates the work path P of the food supply magazine 204. A plurality of flexible bands 218 encircle the guide plate 206 and are driven in rotation therearound by a driven roller 220 mounted at the rear of the guide plate 206. The roller 220 is rotatably mounted by way of a pair of brackets 221 that space the roller 220 away from the guide plate 206 and has a central shaft portion 222 that supports a drive pulley, or gear 223 thereon which is connected to a drive source by conventional means, such as a belt or chain drive.

Figure 6:
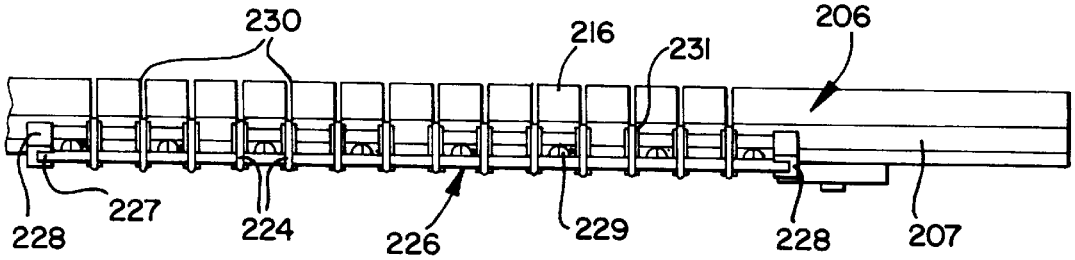
FIG. 6 is a frontal end view of the food slice decurling apparatus of FIG. 4 taken along lines 6—6 of FIG. 5.
Figure 7:
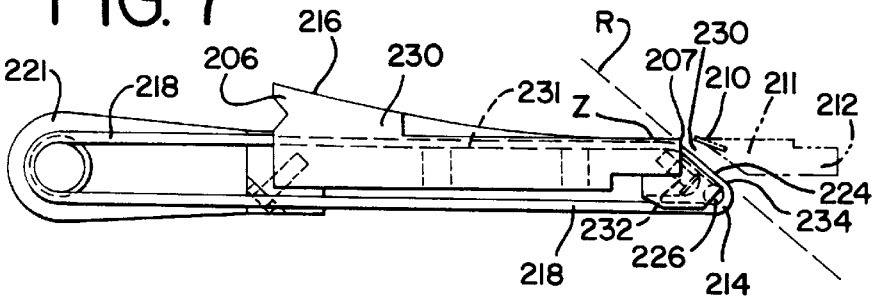
FIG. 7 is an enlarged sectional view of the food slice decurling apparatus of FIG. 4.

Another roller 226 may be rotatably mounted at the front of the guide plate 206 and forms part of the leading edge 214 of the guide plate 206 as shown in FIGS. 4, 6 & 7. The front roller 226 is journaled at its opposing ends 227 within suitable bearing blocks 228. This roller 226 is partially supported by way of a series of projections 229 that extend away from the guide plate 206 down at an angle and assist the roller 226 in defining an inclined path R that the flexible bands 218 take as they approach and pass by the slicing knife 210. The projections 229 may be attached to the front end 207 of the guide plate 206 such as shown by the screws 232 in FIG. 7 and they cooperate to define the leading edge 214 of the guide plate 206. This leading edge 214 as seen best in FIGS. 4 and 7, and particularly in FIG. 7, extends beneath and forward of the slicing knife 210. Alternatively, the projections 229 may be formed as an integral part of the guide plate 206 as illustrated in FIG. 4.

In this embodiment, the second roller 226 acts as an idler roller because it has no applied source of drive attached to it. The roller 226 and its supporting projections are preferably positioned in alignment with the front edge 207 of the guide plate 206 so that no great discrepancy between the surface of the guide plate 206 at the front edge 207 and the surfaces of the flexible bands 218 at the roller 226 occurs. As seen in FIG. 7, the flexible bands 218 at this leading edge 214 form an inclined plane or ramp 234 that define the path R of the bands 218 and moving lower surfaces 224 which opposes the stationary upper surface 211 of the knife holder 212. The moving lower surfaces 224 together with the stationary upper surface 211 on the knife holder 212 together define a construction 230 through which the slice 213 must pass after it is sliced by the knife 210.

The guide plate 206 has a series of grooves, or channels 230, formed in its upper exterior surface 216 that extend longitudinally therein for virtually the entire length L of the guide plate 206. These channels 230, as shown best in FIG. 6 are spaced apart from each other widthwise across a slicing zone Z of the guide plate 206 and terminate at about the front end 207 of the guide plate 206. It will be understood that although in the Figures and the description herein shows, for purposes of clarity, only one slicing assembly and food material supply magazine, that several such slicing assemblies may be utilized with the present invention to accommodate expedient formation of premade set ups. In such instances, the diversion of the slicing zone Z will accommodate the exact number of slicing assemblies used.

Figure 5:
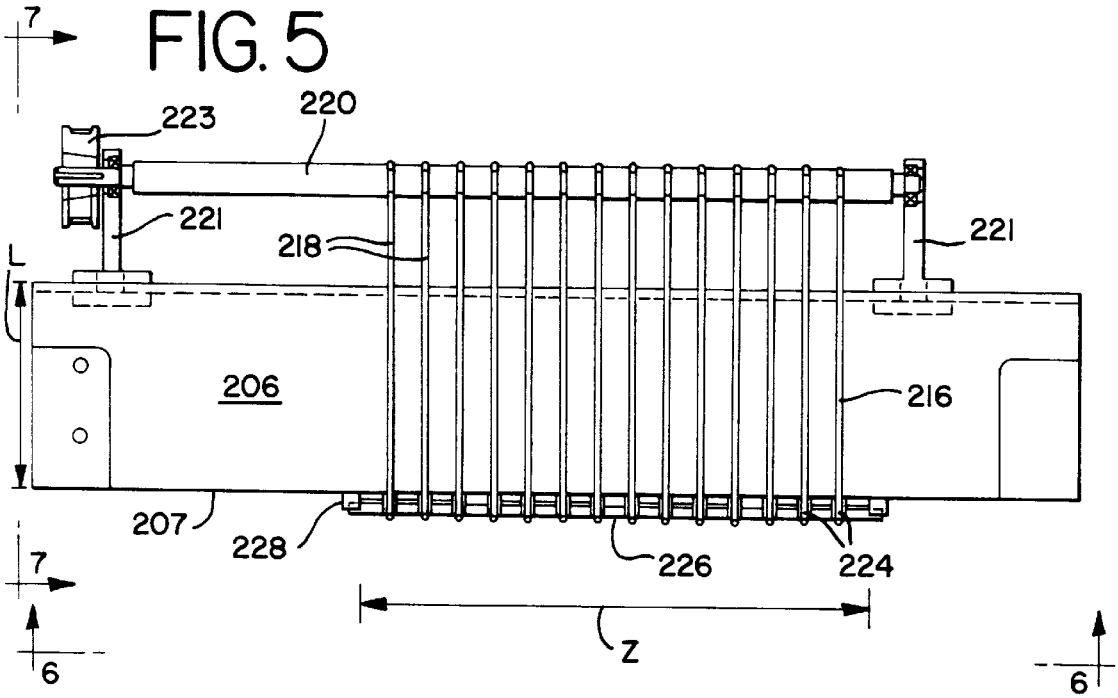
FIG. 5 is a top plan view of the food slice decurling apparatus of FIG. 4.

As mentioned above, the exterior curved surface 216 of the guide plate 206 has a curved profile that preferably matches the arcuate path P that the food material supply magazine 204 takes in its cyclical travel so that the curved surface 216 generally opposes the magazine 204 and the food material supply 202 contained therein during movement of the magazine 204 in a slicing direction (toward the right of FIG. 4) prior to slicing as well as in a return direction (toward the left of FIG. 4) subsequent to slicing. This convex, curved surface eliminates pinching of the food material 202 between the guide plate 206 and the food material supply magazine 204, especially in the slicing direction of the slicing assembly 200. The difference in elevation of the curved surface 216 (FIG. 6) and the base, or bottom, portions 231 of the channels 230 extends for a substantial portion of the length L (FIG. 5) of the guide plate 206 which ensures that the flexible bands 218 do not become displaced out of the channels 230 as can happen with the apparatus 100 illustrated in FIG. 3. In this regard, the flexible bands 218 extend beneath the curved surface 216 of the guide plate 206 for substantially its entire length.

Figure 8:
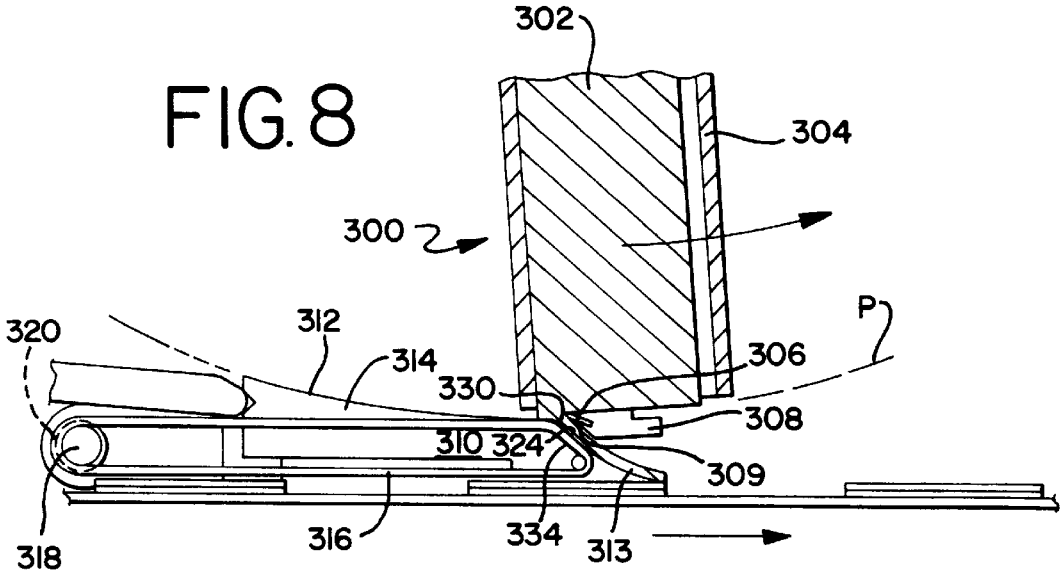
FIG. 8 is a sectional schematic view of another embodiment of a food slice decurling apparatus constructed in accordance with the principles of the present invention.
Figure 9:
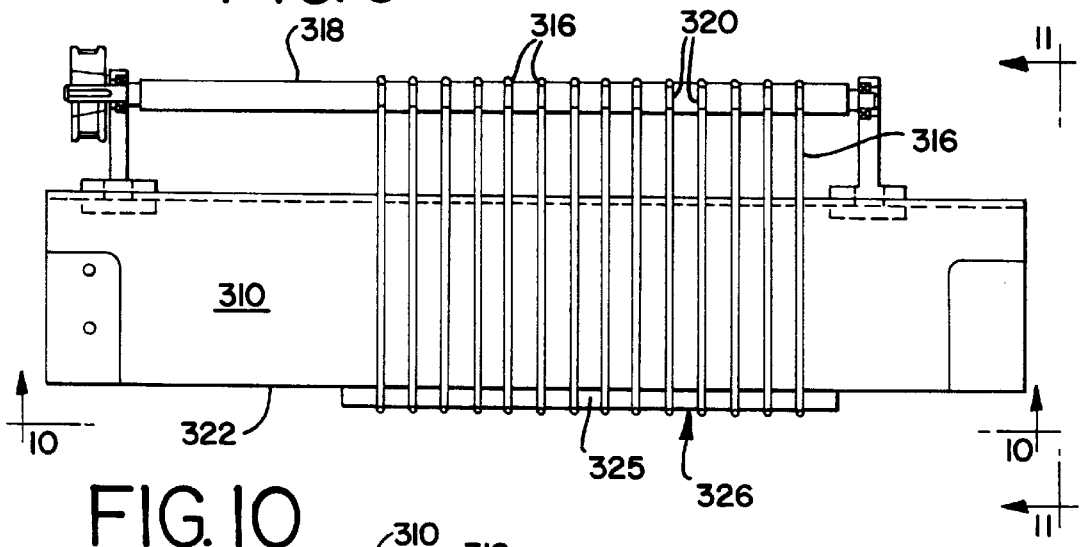
FIG. 9 is a top plan view of the decurling apparatus of FIG. 8.
Figure 10:
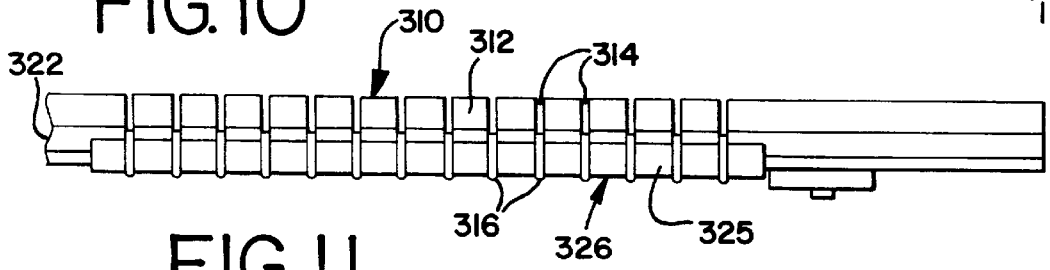
FIG. 10 is a frontal end view of the food slice decurling apparatus of FIG. 8 taken along lines 10—10 of FIG. 9.

Turning now to FIG. 8, a second embodiment of a food decurling apparatus constructed in accordance with the principles of the present invention is illustrated generally at 300. This apparatus 300 is similar to the apparatus 200 of FIGS. 4–7 except that it does not utilize a front roller 226. The apparatus 300 includes a food material supply magazine 304 that holds a food material supply 302 therein positioned for reciprocatable, cyclical movement along a similar curved path P into and out of contact with a slicing knife 306 held within a knife holder 308.

Figure 11:
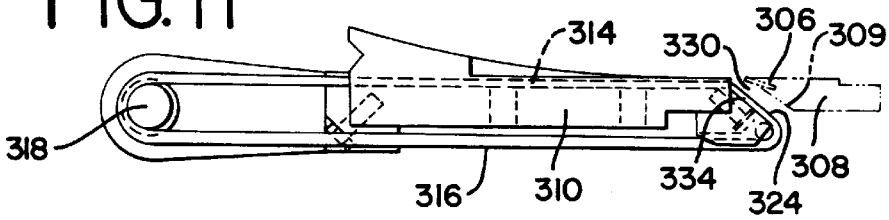
FIG. 11 is an enlarged sectional view of the food slice decurling apparatus of FIG. 8 taken along lines 11—11 of FIG. 9.

A guide member 310 is disposed beneath and extends ahead of the slicing knife 306 and includes a curved upper surface 312 with a plurality of channels 314 formed therein. The channels 314 accommodate flexible bands 316 driven by a roller 318. The roller 318 has a plurality of grooves 320 formed in its outer surface that are aligned with the guide channels 314. The forward end 322 of the guide member 310 has a solid curved, or rounded, end or projection 325 attached to it that forms a curved and downwardly descending leading edge 326 of the guide member 310 that directs the flexible bands 316 down at an angle from their path through the guide plate channels 314. This solid curved leading edge 326 is preferably formed from a material which does not deteriorate the flexible bands 316, such as stainless steel, teflon or a highly polished metal. The radius of the leading edge 326 is preferably large enough to reduce any detrimental wear on the bands 316 and permit them 316 to freely pass over it. As in the embodiment shown in FIGS. 4–7, in this embodiment as best seen in FIGS. 7 and 11, the flexible bands 316 at the leading edge 326 form an inclined plane or ramp 334 that define moving lower surfaces 324 which oppose the stationery upper surface 309 of the knife holder 308. The moving lower surfaces 324 together with the stationary upper surface 309 on the knife holder 308 together define a construction 330 through which the slice 313 must pass after it is sliced by the knife 306. This embodiment simplifies the assembly cost of the apparatus 300 by eliminating the idler roller 226 and the journals to support it. The integral nature of this embodiment also makes the device easier to clean and sanitize.

Figure 12:
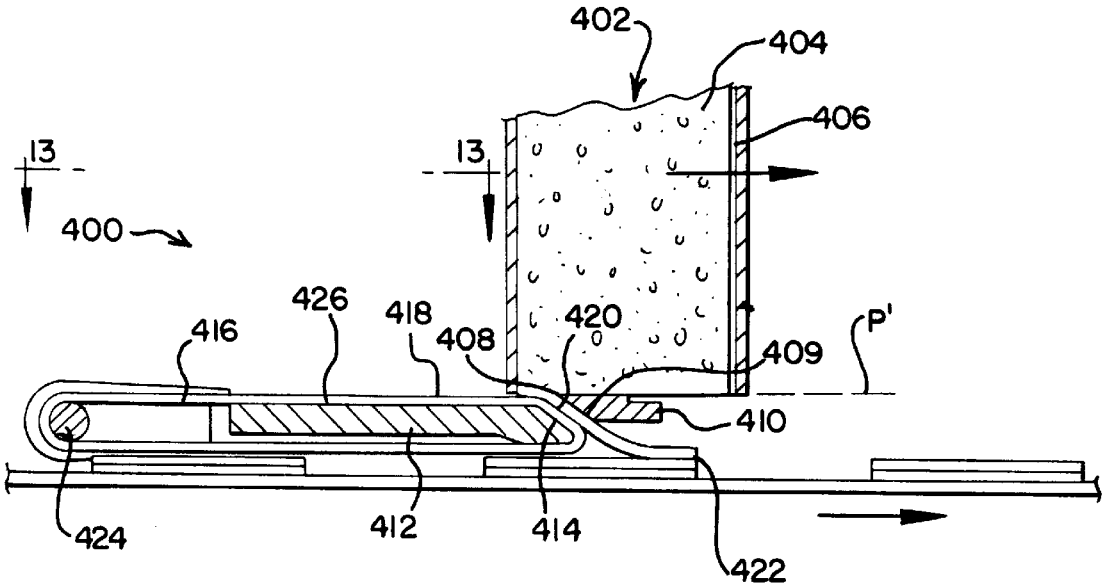
FIG. 12 is a section schematic view of a third embodiment of a food slice decurling apparatus constructed in accordance with the principles of the present invention.
Figure 13:
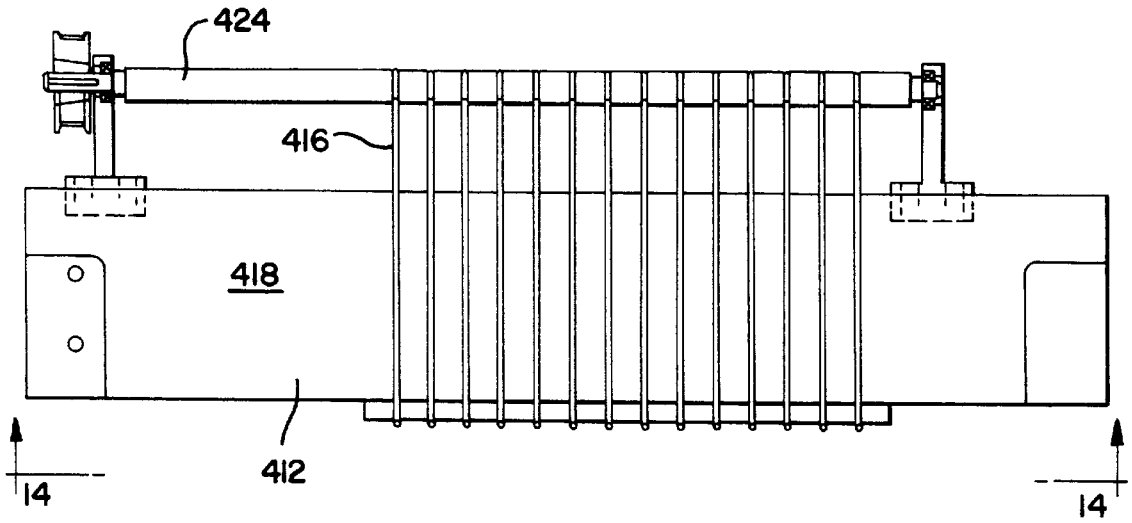
FIG. 13 is a top plan view of the decurling apparatus of FIG. 12 taken along lines 13—13 thereof; and, FIG. 14 is a frontal end view of the decurling apparatus of FIG. 12 taken along lines 14—14 thereof.
Figure 14:
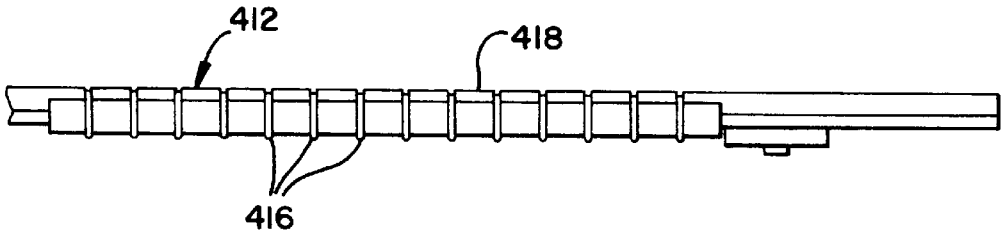

A third embodiment of a decurling apparatus 400 constructed in accordance with the principles of the present invention is illustrated in FIGS. 12–14. This embodiment is particularly suitable for the production of pizzas where the food material supply 402 includes multiple food material sticks 404 held in movable food material supply magazines 406, as well as for the production of pre-made set ups as shown in FIG. 12 when it is required that the sticks 404 be deployed transversely as well as in the machine direction. The supply magazine 406 is moved in a translational path, i.e., linearly back and forth across the slicing knife 408, with a slicing movement being illustrated by the arrow in FIG. 12. This translational path P' is linear and differs from the curved partly rotational path P of the previously described embodiments.

The slicing knife 408 is positioned by a knife guide 410 that is mounted beneath the food supply magazine 406. A second guide, in the form of a planar guide plate 412, is also mounted beneath the food supply magazine 406 and spaced apart therefrom to define a constriction 414 adjacent to the slicing knife holder 410 and its stationary surface 409. A series of rotating members, such as flexible bands 416, are provided at preselected intervals in grooves 426 on the surface 418 of the guide plate 412 to define a moving surface 420 in opposition to the stationary surface 409 of the knife holder 410 and beneath the food supply 402. This moving surface 420, as explained above, propels the slice 422 through the constriction 414 at a speed substantially equal to or greater than the speed of the cutting movement of the food supply 402. The bands 416 are driven in their movement by one or more rollers 424.

The guide plate 412 is further oriented parallel to and along the path of travel of the food supply magazine 406, just as in the previously described embodiments, thus the configuration of the guide plate defines part of the food supply path P'. Because the slicing knife of the present invention is substantially fixed, the food material supply is allowed to move above and in unison with the conveyed product upon which subsequent slices are to be assembled, thereby causing the slices to fall in proper position on the product lying on the conveyor without disrupting the conveying motion of the apparatus. It will be understood that the present invention therefore results in more efficient slicing of food products without curling occurring.

It will be seen that while certain embodiments of the present invention have been shown and described, it will be obvious to those skilled in the art that changes and modifications may be made therein without departing from the true spirit and scope of the inventions.

We claim:

1. An apparatus for decurling successive slices of a food material comprising:

a food material supply for holding the food material to be sliced, said food material supply being reciprocally movable along a predetermined arcuate path of travel;

a slicing knife in said arcuate path of travel and positioned so as to slice a slice of food material from the food material in said food material supply as the supply is moved along said arcuate path of travel and into said slicing knife;

distinct stationary and moving surfaces disposed proximate to said slicing knife, the stationary and moving surfaces defining a constriction therebetween through which said severed slice of food material is passed after the slice is severed from the food material in said supply;

a guide plate disposed along a portion of said arcuate path in opposition to said food material supply, said guide plate having a curved profile which approximates said predetermined arcuate path of travel of said food material supply as said supply moves into and out of contact with said slicing knife, said guide plate including a leading edge which angles downwardly adjacent said moving surface and spaced from said stationary surface to further define said constriction, and said leading edge and moving surface extends beyond said slicing knife.

2. The apparatus of claim 1, including a transfer conveyor beneath said constriction to receive the slice of food material.

3. The apparatus of claim 1, wherein said moving surface is defined by a plurality of flexible bands extending around at least a portion of said guide plate in spaced apart order and said apparatus includes a roller for driving said flexible bands around said guide plate and beneath said guide plate curved profile.

4. The apparatus of claim 1, wherein said guide plate includes a series of spaced-apart channels disposed in said guide plate and on a side thereof adjacent said curved profile, each of said channels in said guide plate terminating near said front end, said guide plate further including a series of flexible, driven bands encircling at least a portion of said guide plate, each of the flexible bands being disposed in a single one of said channels.

5. The apparatus of claim 1, wherein said food material supply includes a magazine member reciprocates along an arc in opposing first and second directions, the food material in said food material supply engaging said slicing knife when said magazine member moves in said first direction, said apparatus moving surface also moving in said first direction.

6. The apparatus of claim 1, wherein said moving surface moves at a speed at least nominally equal to a speed at which said food material slices are sliced from said food material supply.

7. The apparatus of claim 1, wherein said leading edge of said guide plate beyond said slicing knife includes an idler roller.

8. The apparatus of claim 1, wherein said leading edge of said guide plate beyond said slicing knife includes a stationary surface.

9. The apparatus of claim 1, wherein said leading edge of said guide plate is defined at least in part by projections.

10. The apparatus of claim 1, wherein said moving surface is defined by first and second rotatable members and a plurality of flexible bands interconnecting said rotatable members, said first rotatable member having a generally cylindrical outer surface with a plurality of circumferential grooves disposed therein, each of said first rotatable member circumferential grooves containing a flexible band therein, each of the flexible bands being at least partially guided in movement along a first path between said first and second rotatable members by a series of spaced-apart channels disposed in said guide plate curved profile, said guide plate further having a leading edge positioned adjacent said second rotatable member, said guide plate leading edge directing said flexible bands in movement along a second path between said first and second rotatable members, the second path angularly diverging from said first path.

11. The apparatus of claim 10, wherein said second path extends downwardly relative to said first path.

12. The apparatus of claim 1, wherein said guide plate includes a solid, curved leading edge extending along a first end of said guide plate, the leading edge including a solid, angled face that opposes said stationary surface.

13. The apparatus of claim 12, wherein said guide plate includes a plurality of channels formed therein, the channels being spaced apart from each other across a width of said guide plate, said channels extending beneath said curved of said guide plate profile to said leading edge.

14. The apparatus of claim 1, wherein said moving surface is defined by a plurality of flexible bands which extends around two rollers.

15. The apparatus of claim 2, wherein said guide plate is disposed between said rollers and said flexible bands envelop at least a portion of said guide plate.

16. The apparatus of claim 15, wherein said guide plate includes a plurality of channels corresponding in number to said plurality of flexible bands, said flexible bands extending longitudinally through said channels in said guide plate in a straight path substantially beneath said guide plate curved profile.

17. An apparatus for substantially removing any curl imparted to individual slices of a food material comprising, in combination:

a food material supply which is capable of containing a food material and which is capable of movement back and forth along a predetermined work path defining a food slicing direction and a return direction, a slicing knife interposed along the work path of said food material supply, the slicing knife being engaged by the food material in said food material supply when said food material supply moves in the food slicing direction, and first and second surfaces defining a constriction disposed adjacent said slicing knife, the first surface being a stationary surface disposed adjacent said slicing knife and the second surface being a moving surface disposed on a guide plate, the guide plate being positioned adjacent to said slicing knife and parallel to said work path, the moving surface moving in said food slicing direction, said moving surface being formed by a plurality of flexible bands enveloping a portion of the guide plate and being driven around said guide plate by a roller, the roller having a plurality of circumferential grooves disposed in an outer surface thereof, said guide plate including an exterior surface having a profile that approximates at least a part of said work path, said exterior surface of the guide plate further lying in opposition to said food material supply through a portion of its movement in said slicing and return directions, said exterior surface of the guide plate including a plurality of longitudinal grooves disposed therein, each of the longitudinal grooves having one of said plurality of flexible bands disposed therein, said longitudinal grooves guiding said flexible bands in driven movement over said guide plate substantially beneath said guide plate exterior surface, said guide plate also including a leading edge spaced-apart from said roller and which angles downwardly adjacent said moving surface and spaced from said stationary surface to further define said constriction, and said leading edge and moving surface extend beyond said slicing knife, said leading edge further directing said flexible bands in movement over said guide plate, whereby a food material slice deposited on said moving surface is passed through said constriction without a substantial curl.

18. The machine of claim 17, wherein said leading edge is angularly offset from said guide plate longitudinal grooves.

19. The machine of claim 17, wherein said constriction stationary surface at said constriction is generally planar.

20. The machine of claim 17, wherein said flexible bands are driven at a speed at least nominally equal to a slicing speed.

21. The machine of claim 17, wherein said guide plate exterior surface and said work path are curved.

22. The machine of claim 17, wherein said leading edge has a solid face opposing said slicing knife, said flexible bands being driven over said leading edge solid face by said roller.

23. The apparatus of claim 17, wherein said leading edge of said guide plate beyond said slicing knife includes an idler roller.

24. The apparatus of claim 17, wherein said leading edge of said guide plate beyond said slicing knife includes a stationary surface.

25. The apparatus of claim 17, wherein said leading edge of said guide plate is defined at least in part by projections.

* * * * *

UNITED STATES PATENT AND TRADEMARK OFFICE

CERTIFICATE OF CORRECTION

PATENT NO : 6,044,739

DATED : April 4, 2000

INVENTOR(S) : Norman C. Abler, James A. Rattmann and Donald W. Hamburg

It is certified that error appears in the above-identified patent and that said Letters Patent are hereby corrected as shown below:

On the Cover Page, the title should read --FOOD MATERIAL DECURLING APPARATUS--.
Col. 1, first line, the title should read --FOOD MATERIAL DECURLING APPARATUS--.
Col. 2, line 13, "has a outer" should read --has an outer--.
Col. 3, line 18, delete "numeral" and insert --numerals--.
Col. 6, line 4, delete "opposes" and insert --oppose--.
Col. 8, line 44, after "member" insert --which--.
Col. 9, lines 20-21, delete "of said guide plate profile" and insert --profile of said guide plate--; line 23, delete "extends" and insert --extend--; line 25, delete "2" and insert --14--.
Col. 10, line 32, delete "constriction".

Signed and Sealed this

Tenth Day of April, 2001

*Attest:*

Nicholas P. Godici

NICHOLAS P. GODICI

*Attesting Officer*

*Acting Director of the United States Patent and Trademark Office*